US005225613A

United States Patent [19]

Claridge

[11] Patent Number: 5,225,613

[45] Date of Patent: Jul. 6, 1993

[54] APPARATUS AND METHOD FOR STORING AMMUNITION CLIP

[75] Inventor: Joseph M. Claridge, Northridge, Calif.

[73] Assignee: Claridge Hi-Tec, Inc., Northridge, Calif.

[21] Appl. No.: 762,973

[22] Filed: Sep. 20, 1991

[51] Int. Cl.[5] ..... F41C 23/08

[52] U.S. Cl. ..... 42/74

[58] Field of Search ..... 42/71.01, 71.02, 75.03, 42/74, 73

[56] References Cited

U.S. PATENT DOCUMENTS

| | | | |
|---|---|---|---|
| 151,882 | 6/1874 | Jones | 42/71.02 |
| 699,608 | 5/1902 | Winters | 42/74 |
| 922,173 | 5/1909 | Lovelace | 42/71.01 |
| 931,766 | 8/1909 | Kennedy | 42/71.01 |
| 939,707 | 11/1909 | Kennedy | 42/71.01 |
| 950,515 | 3/1910 | Rodgers | 42/71.01 |
| 1,485,456 | 3/1924 | von Frommer | 42/71.01 |
| 1,505,146 | 8/1924 | Holub | 42/71.01 |
| 1,526,847 | 2/1925 | Fritz | 42/71.01 |
| 2,484,168 | 10/1949 | Jachimiec | 42/71.01 |
| 2,495,977 | 1/1950 | Madsen | 42/71.01 |
| 2,650,446 | 9/1953 | Bivens | 42/74 |
| 2,667,005 | 1/1954 | Weis | 42/74 |
| 3,208,180 | 9/1965 | Woodcock | 42/74 |
| 4,115,943 | 9/1978 | Musgrave | 42/71.01 |
| 4,697,367 | 10/1987 | Brophy | 42/71.01 |

FOREIGN PATENT DOCUMENTS

| | | | |
|---|---|---|---|
| 215597 | 10/1909 | Fed. Rep. of Germany | 42/71.01 |
| 510956 | 5/1957 | Italy | 42/71.01 |
| 264338 | 1/1950 | Switzerland | 42/71.01 |

*Primary Examiner*—Stephen M. Johnson
*Attorney, Agent, or Firm*—Lyon & Lyon

[57] ABSTRACT

A storage space for an ammunition clip is built into the stock of a gun. The clip preferably contains 16 bullets, and can either be the main clip or an auxiliary clip.

1 Claim, 1 Drawing Sheet

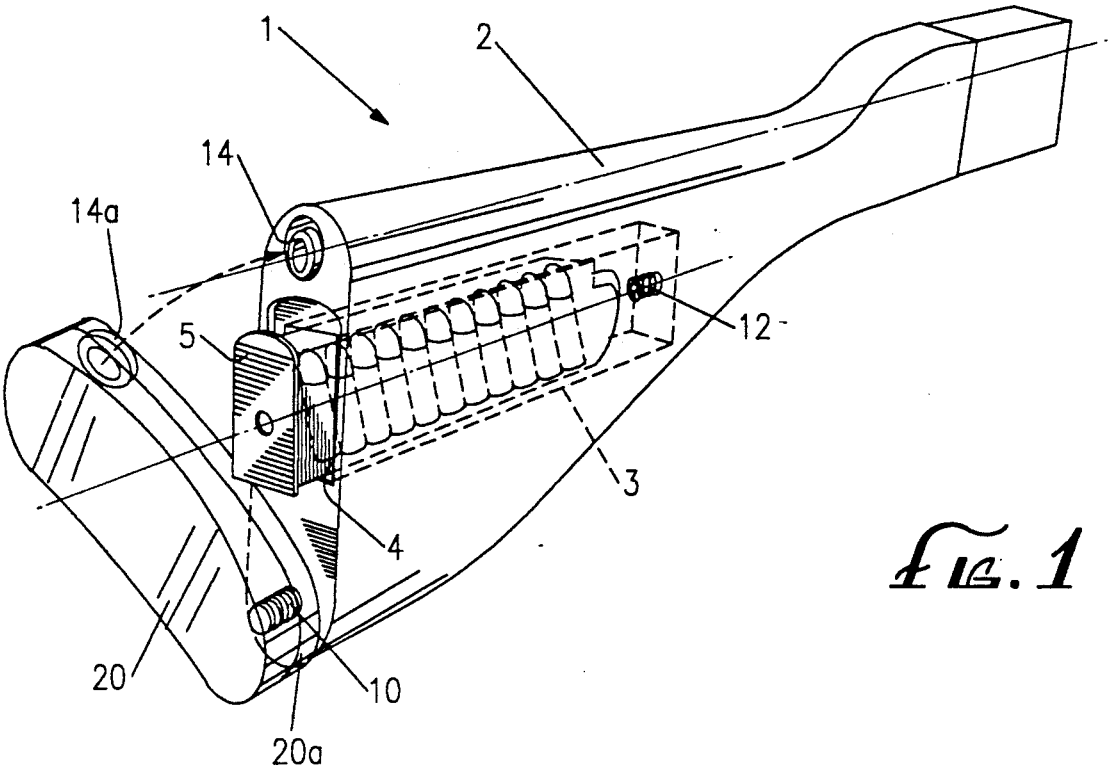
FIG. 1
FIG. 2
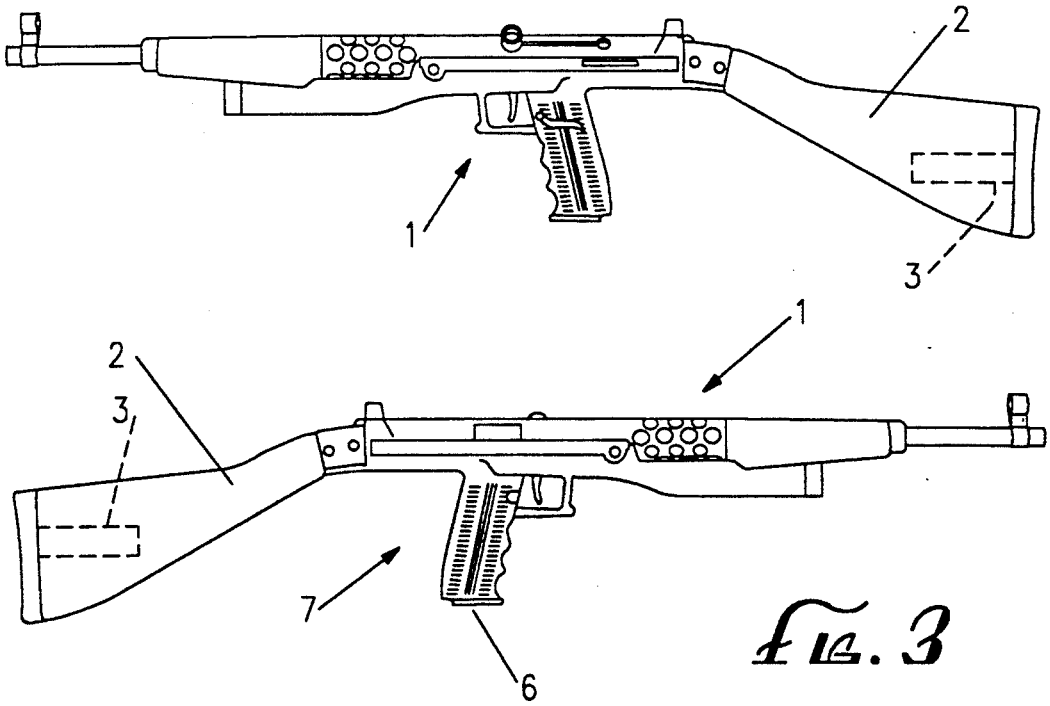
FIG. 3

APPARATUS AND METHOD FOR STORING AMMUNITION CLIP

BACKGROUND OF THE INVENTION

The present invention relates to the field of guns.

It is well known that guns are used to shoot projectiles such as bullets at a target, and that bullets can be inserted into the chamber of a gun using an ammunition clip, which can be loaded into the gun. One advantage of using clips as opposed to separate bullets is that a relatively large number of bullets can be loaded into a gun in a relatively short period of time.

In the case of carbines, it is known that individual bullets can be stored in the butt of the carbine. While this approach permits ready access to a cache of extra bullets, it suffers from the drawback that a user may still be required to remove the bullets from the butt and insert them into a clip before the extra bullets can be utilized. This procedure may be time consuming and awkward, especially if the bullets are being accessed from the butt of the gun under time pressure or under fire.

SUMMARY OF THE INVENTION

The present invention is directed to the storage of bullets in a clip in the butt of a carbine or other gun having a sufficiently large butt. In operation, a door or hatch on the butt of the gun can be opened and a clip containing extra bullets can be stored or removed. The clip can be immediately removed and loaded into the gun. Since the bullets have been previously inserted into the clip, this invention solves the problems discussed above with respect to having to insert the bullets into a clip under time pressure.

It is accordingly an object and advantage of this invention to provide a means of storing extra bullets in a clip or clips in the butt of a gun.

BRIEF DESCRIPTION OF THE DRAWINGS

This and other objects and advantages of the present invention will become better understood through a consideration of the following description taken in conjunction with the drawings in which:

FIG. 1 is a partial cutaway perspective view of a butt of a gun with an internal chamber to removeably secure the clip and a side view of an ammunition clip, partially inserted therein.

FIGS. 2 and 3 present side views of a carbine showing with dashed lines the location of the clip stored in the butt of the gun.

DETAILED DESCRIPTION OF THE PREFERRED EMBODIMENT

Turning now to the drawings, in FIG. 1 a gun 1 has a butt or stock 2 containing a cavity 3. The stock is preferably made out of black graphite composite. The cavity 3 has a mouth or opening 4, and is sized and dimensioned to receive at least one ammunition clip 5. In the preferred embodiment, the cavity is rectangular for storage of one sixteen round clip. The clip 5 is shown in solid lines as removed from the cavity 3, and is shown in dashed lines as positioned within the cavity. The clip 5 may be auxiliary to a main clip 6 which, as shown in FIGS. 2 and 3 is inserted in the handle of the pistol grip 7 of the gun. It may also be desirable to store the main clip in the cavity 3 so that the rifle may be transported more safely without a loaded clip. A combination rubber and graphite butt pad 20 is pivotally positioned on a screw mount swivel 10 to cover the mouth 4 of the cavity 3, and can be moved between an open position (as shown) and a closed position (not shown). A portion of the pad is graphite 20*a*. The butt pad is permanently pinned to the stock. A spring 12 is used to facilitate, removeability of the clip from the butt of the carbine.

A button snap or latch 14 and 14*a* serves to hold the butt pad in place against the stock Although the mouth 4 of the cavity 3 is depicted in FIG. 1 as being positioned at the back of the stock 2, a mouth or opening could also be positioned to the side, top or bottom of the stock. Additionally, the door can be hinged, slidably operated, or otherwise attached to the stock.

Thus, the storage of an ammunition clip in the butt of a gun has been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. In a rifle having a stock with a longitudinal axis, a combination flexible recoil pad and cover member for allowing storage of a spare clip within a cavity in the said stock, said cover member having means for mounting a swivel pin axially thereto at one end of said cover so it can be attached to the stock and so that it can pivot in a plane substantially perpendicular to the axis of the stock, and therefore open the cavity to allow removal or insertion of the clip, and also having a means for fastening an opposite end of said cover member to the stock, whereby said cover member acts as both a shock absorber and a door which can open and close to allow the clip to be stored or removed from the stock, and wherein the flexibility and shock absorbing characteristics are attained by suing a layer of graphite and a layer of rubber.

* * * * *